United States Patent [19]

Garrick et al.

[11] Patent Number: 4,815,644

[45] Date of Patent: Mar. 28, 1989

[54] APPARATUS FOR SEGMENTING BUILDING BOARDS

[75] Inventors: John R. Garrick; Karl B. Himmelberger, both of Lancaster, Pa.

[73] Assignee: Armstrong World Industries, Inc., Lancaster, Pa.

[21] Appl. No.: 116,491

[22] Filed: Jan. 11, 1988

Related U.S. Application Data

[62] Division of Ser. No. 904,329, Sep. 8, 1986, Pat. No. 4,742,945, which is a division of Ser. No. 690,980, Jan. 14, 1985, Pat. No. 4,646,955.

[51] Int. Cl.[4] ..... B26F 3/00

[52] U.S. Cl. ..... 225/97; 225/3; 225/96.5; 225/103

[58] Field of Search ..... 225/2, 3, 96, 96.5, 225/97, 103

[56] References Cited

U.S. PATENT DOCUMENTS 3,779,437 12/1973 Yamamoto et al. ..... 225/3 X 4,049,167 9/1977 Guissard ..... 225/3 X

*Primary Examiner*—Frank T. Yost

[57] ABSTRACT

The present invention relates to a method and apparatus for segmenting groove molded building boards. In a preferred embodiment, a sheet of groove molded board is conveyed onto a first apparatus which separates the side edge trim scrap from the board. The board then passes onto a segmenting apparatus comprising a first horizontal conveyor, an inclined conveyor, a second generally horizontal conveyor, and adjustably mounted roller assemblies. The first apparatus removes the side-edge trim scrap from the board and the second segmenting apparatus breaks the groove molded board transversely along the groove molded lines. In addition, the second apparatus separates the leading and trailing edge scrap so as to provide individual board panels which require no additional trimming. As an alternative, two segmenting conveyors can be used in tandem so as to remove all of the scrap, thereby obviating the need for the first trim-scrap removing apparatus.

4 Claims, 7 Drawing Sheets

APPARATUS FOR SEGMENTING BUILDING BOARDS

CROSS-REFERENCE TO RELATED APPLICATION

This is a division of application Ser. No. 904,329, filed on Sept. 8, 1986 now U.S. Pat. No. 4,742,945, which is a divisional application of Ser. No. 690,980, filed on Jan. 14, 1985, now U.S. Pat. No. 4,646,955.

The present invention relates to a method for segmenting building boards, and more particularly to a method for segmenting building boards without the use of saws or other cutting apparatus.

BACKGROUND OF THE INVENTION

Building boards, and more particularly, ceiling boards, have conventionally been made by wet laying processes and the boards resulting from such processes have had to be sawed in order to yield product having a required dimension. The use of saws is undesirable for a number of reasons. One reason is that a substantial amount of dust is created during the sawing process, thereby leading to fire hazards, and air pollution and health hazards. A second reason is that difficulty has often been encountered in maintaining saw registration so as to consistently provide product having exact dimensions and exact geometry (e.g., squareness).

Recently, U.S. Pat. No. 4,476,175 disclosed groove molded building boards which were prepared such that the use of saws could be avoided. Each board was provided with grooved lines of demarcation which permitted the removal of edge scrap, and also permitted the boards to be easily divided into individual board segments. However, no apparatus existed for the processing of such boards, and the separation of the scrap and the dividing of the boards into individual pieces had to be accomplished by hand.

A number of prior art references disclose apparatus for segmenting sheet materials. Certain of these references pertain to the segmenting of materials such as crackers; thus, U.S. Pat. No. 2,252,362 discloses apparatus whereby transversely weakened sheets of crackers can be conveyed through a station comprising a plurality of hold-down means such that, when the crackers pass over a fulcrum point, the crackers are fractured along the lines of weakness. U.S. Pat. No. 2,555,916 discloses a different type of apparatus comprising a conveyor band and a breaker band whereby the breaker and conveyor cooperate to fracture preweakened sheets of crackers along the lines of weakness.

Other references are also directed to the segmenting of building materials such as plaster board. Thus, U.S. Pat. No. 2,311,995 discloses a stacked breaking means by which plaster board may be passed over a series of rolls and flexed such that the board is fractured along preweakened lines. In addition, British Patent Specification No. 827,611 discloses apparatus by which a preweakened plaster board having a perforated top and bottom paper facing may be passed along the conveyor and over a hump, after which the leading edge of the board contacts a downwardly directed belt. The combination of the hump and the downwardly directed belt causes the board to flex and break along the lines of weakness.

Other references also relate to the segmenting of sheet materials. Thus, U.S. Pat. No. 3,517,869 discloses apparatus for breaking a prescored glass sheet whereby one end of a conveyor bearing the sheet is moved downwardly in a vertical direction to cause the glass to fracture along the score line. Also, West German Offenlegungsschrift No. 26 33 013 discloses apparatus by which a transversely weakened sheet material can be passed onto an upwardly directed conveyor and subsequently onto a horizontal conveyor, during which time the leading edge of the sheet is contacted by a downwardly directed belt. The combination of passing the sheet onto an inclined conveyor and then contacting it with a downwardly directed belt causes the bottom edge and then the upper edge of the transverse weakening lines to fracture, thereby segmenting the sheet.

Despite the existence of these references, no method was known in the art to separate a groove molded sheet-like building board material into individual panels while at the same time separating the sheet from the board scrap.

Accordingly, one objective of the present invention was to provide a simplified means of segmenting a groove molded building board while at the same time separating the board panels from the scrap.

Yet another objective of the present invention was to provide apparatus for segmenting a groove molded building board whereby the use of saws was avoided.

These and other advantages of the present invention will become apparent from the detailed description of the preferred embodiments which follow.

SUMMARY OF THE INVENTION

Figure 1:
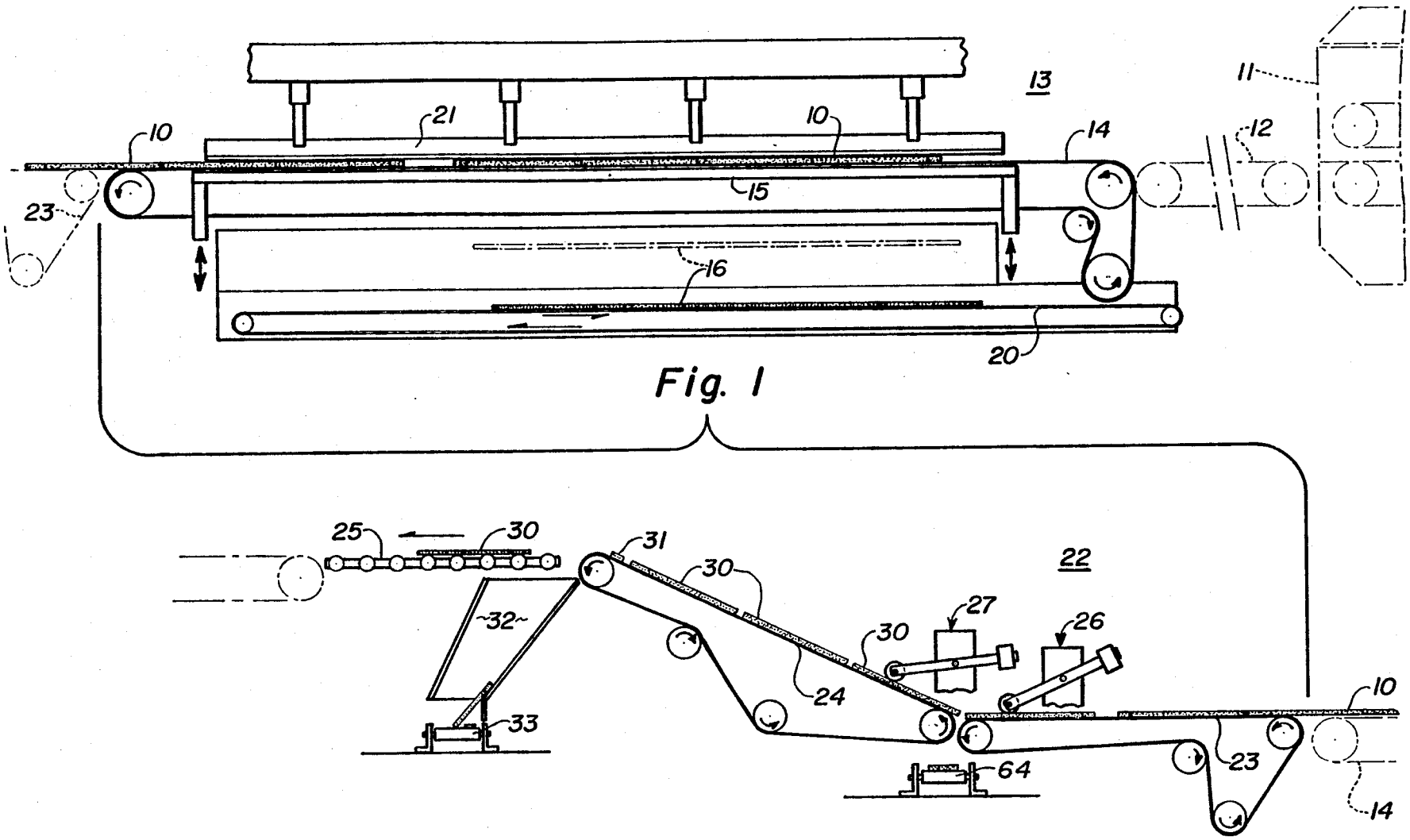
FIG. 1 is a side view of a preferred embodiment comprising a first side-edge scrap removing apparatus and a second segmenting apparatus.

The present invention relates to a method and apparatus for segmenting groove molded building boards. In a preferred embodiment, a sheet of groove molded board is conveyed onto a first apparatus which separates the side edge trim scrap from the board. The board then passes onto a segmenting apparatus comprising a first horizontal conveyor, an inclined conveyor, a second generally horizontal conveyor, and adjustably mounted roller assemblies. The first apparatus removes the side-edge trim scrap from the board and the second segmenting apparatus breaks the groove molded board transversely along the groove molded lines. In addition, the second apparatus separates the leading and trailing edge scrap so as to provide individual board panels which require no additional trimming. As an alternative, two segmenting conveyors can be used in tandem so as to remove all of the scrap, thereby obviating the need for the first trim-scrap removing apparatus.

DETAILED DESCRIPTION OF PREFERRED EMBODIMENTS

In one embodiment, the present invention relates to an apparatus for removing side-edge trim scrap from a groove molded building board, said apparatus comprising conveyor means, said conveyor means being adapted to receive a groove molded building board comprising upwardly groove molded side-edge trim scrap and to convey said board to a designated position in said apparatus, said conveyor means comprising means for temporarily stopping said board at said position; hold-down means, said hold-down means being disposed such that it can prevent said board from moving when said board is stopped at said position; side-edge trim-scrap removing bars disposed beneath said edge scrap when said board is stopped at said position, said bars comprising vertical lifting means whereby said bars may be contacted with said edge scrap so as to cause said scrap to move upwardly, thereby causing said scrap to be separated from said board; and means for reactivating said conveyor means so as to cause said board to be removed from said apparatus.

In a second embodiment, the present invention relates to apparatus for segmenting unitary transversely grooved building boards, said apparatus comprising a segmenting conveyor system, said system comprising first and second conveyors in tandem, said conveyors having an angle of intersection which is about 100° to about 160°; and an adjustably mounted roller assembly disposed above said first conveyor, said roller assembly being disposed such that it can cooperate with upwardly transversely groove molded building boards moving on said conveyor system so as to induce said boards to segment along the tranverse groove lines.

In a third embodiment, the present invention relates to a process for segmenting unitary transversely groove molded building boards, said process comprising the steps of providing a segmenting conveyor system comprising in tandem a first conveyor and a second conveyor, the angle of intersection between said first and second conveyors being about 100° to about 160°, said system comprising an adjustably mounted roller assembly disposed above said first conveyor, said assembly being disposed such that it can cooperate with upwardly transversely groove molded building boards moving on said conveyor system so as to induce said boards to segment along the transverse groove lines; conveying said boards on said system in a direction from said first conveyor to said second conveyor; and sequentially contacting each transverse board segment with said roller assembly such that each transverse segment which follows a groove line is maintained substantially in the plane of said first conveyor as the transverse segment which precedes said groove line is conveyed onto said second conveyor, whereby said board is induced to segment along said groove line.

In a fourth embodiment, the present invention comprises a process for removing trim scrap from and for segmenting groove molded building boards, said process comprising the steps of providing a first side-edge trim-scrap removing apparatus comprising conveyor means, hold down means and side-edge scrap-removing bars; providing a second segmenting apparatus, said apparatus comprising a first conveyor and a second conveyor in tandem, said conveyors having an angle of intersection which is about 100° to about 160°, and an adjustably mounted roller assembly disposed above said first conveyor, said roller assembly being disposed such that it can cooperate with upwardly transversely groove molded building boards moving on said conveyor system so as to induce said boards to segment along the transverse groove lines; and passing unitary groove molded building boards comprising side-edge trim scrap, leading-edge trim scrap and board panels through said first and second apparatuses, whereby said side-edge and leading-edge trim scrap is removed from said boards, and the boards are separated into individual board panels.

In a fifth embodiment, the present invention comprises a process for segmenting and removing trim scrap from groove molded building boards, said process comprising the steps of providing a first and a second segmenting conveyor system, each said system comprising in tandem a first conveyor and a second conveyor, the angle of intersection between each said first and second conveyor being about 100° to about 160°, each said system comprising an adjustably mounted roller assembly disposed above each said first conveyor, each said assembly being disposed such that it can cooperate with upwardly transversely groove molded building boards or board segments moving on each respective system so as to induce said boards to segment along the transverse groove lines; conveying said boards on said first system in a direction from said first conveyor to said second conveyor; orienting each transversely separated segment such that one side edge becomes the leading edge as said segment passes to said second segmenting conveyor system; and conveying said segment through said second system in a direction from said first conveyor to said second conveyor, whereby as said boards pass through said first system and as said segments pass through said second system, each board and segment, respectively, is sequentially contacted with each said roller assembly such that each transverse segment which follows a transverse groove line is maintained substantially in the plane of each said first conveyor as each transverse segment which precedes said groove line is conveyed onto each said second conveyor, said boards and segments, respectively, being induced to sequentially segment along said transverse groove lines.

Figure 7:
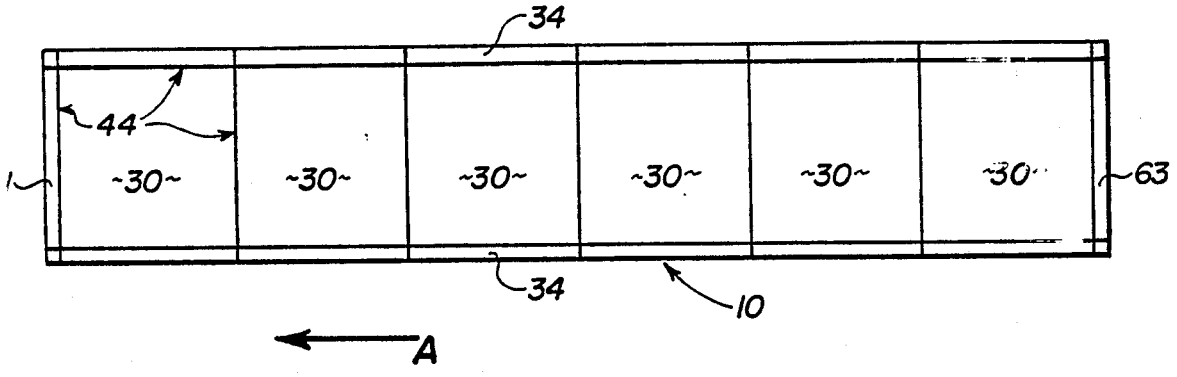
FIG. 7 represents a plan view of a typical groove molded building board.

The present invention is best understood by reference to the drawings. FIG. 1 represents a cross-sectional view of one preferred embodiment of the present invention. Groove-molded board 10 emerges from press 11 and passes onto conveying means 12 by which it is transported to side-edge trim-scrap remover 13. In a commercial operation, board 10 would usually be somewhat wider than two feet in width and somewhat longer than twelve feet in length. A typical board is illustrated in FIG. 7 wherein each panel 30 has a dimension of two feet by two feet and the panels are separated from each other and/or the trim scrap by upwardly directed groove molded lines 44. If the board moves in the direction of arrow A, the leading-edge trim scrap is identified as 31, the trailing-edge trim scrap is identified as 63 and the side-edge trim scrap is identified as 34. In a typical board, the open angle of the groove (arc B of FIG. 8) can vary from about 26° to about 90°. This angle may constitute the groove between board panels 30, as illustrated, or it may constitute the groove between panels 30 and the various edge-trim pieces.

Board 10 passes onto parallel conveying belts 14 which transport board 10 through side-edge trim-scrap remover 13. During the course of passage through trim-scrap remover 13, board 10 is temporarily stopped and edge trim bars 15 move in a vertical manner so as to contact the exposed side-edge trim-scrap 34 and cause it to be separated from board 10. The separated scrap 16 then falls by gravity onto scrap removing conveyor 20. During the course of removal, board 10 is held substantially in place by hold down plates 21. For the sake of convenience, the figures show board 10 as comprising four, rather than six, panels 30. It will also be recognized that other board types may be processed utilizing the present equipment. Thus, two or more parallel rows of panels 30 may be groove molded into a single board, and the side-edge trim scrap 34 may be removed therefrom using the present apparatus. How such boards may be segmented is discussed in more detail below.

Following removal of the side-edge trim scrap, the unitary board passes onto segmenting apparatus 22. Segmenting apparatus 22 comprises a first horizontal conveyor 23, a second inclined conveyor 24 in tandem with conveyor 23, and a receiving conveyor 25 in tandem with inclined conveyor 24. A first roller assembly 26 is disposed over conveyor 23 and a second roller assembly 27 is disposed over inclined conveyor 24. Board 10 passes from conveyor 23 onto conveyor 24 and, as it does so, the board is sequentially induced to break transversely along the upwardly directed transverse groove molded lines, thereby providing board panels 30 and a piece of leading-edge trim scrap 31. As the segmented board passes onto receiving conveyor 25, leading edge scrap 31 falls onto scrap chute 32 and is conveyed away by scrap conveyor 33. Board panel 30, which no longer contains any trim scrap, is conveyed, as desired, to inspection and/or packaging stations (not shown).

Figure 2:
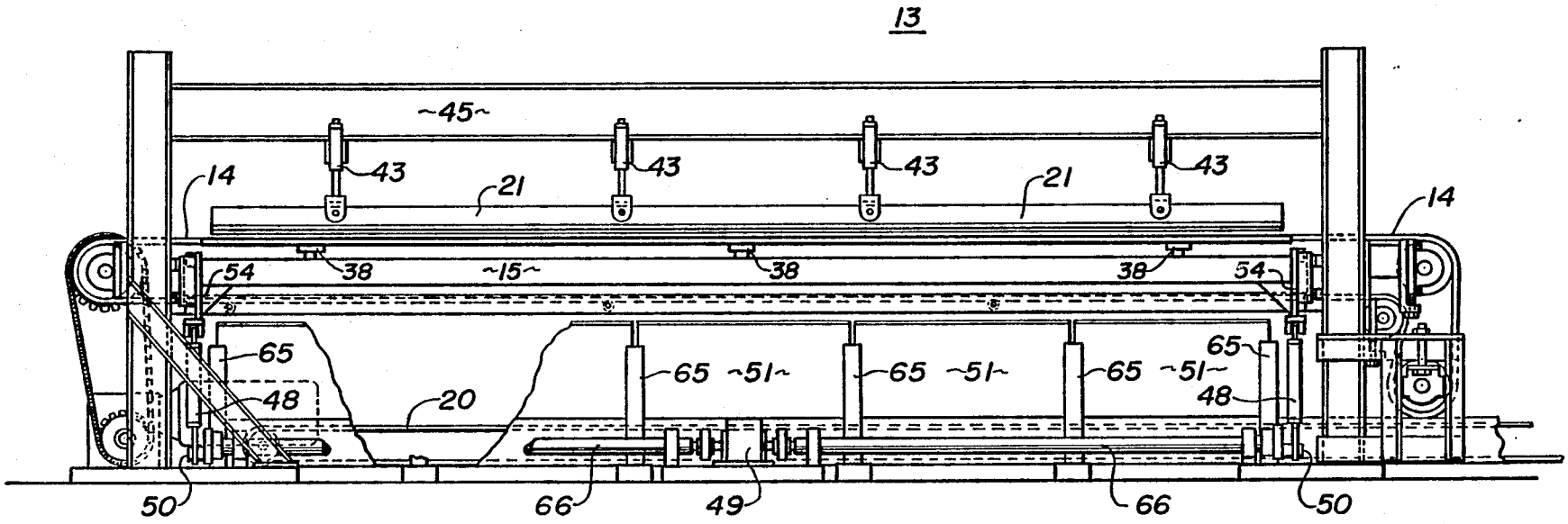
FIG. 2 represents a cross-sectional view of said first apparatus.
Figure 3:
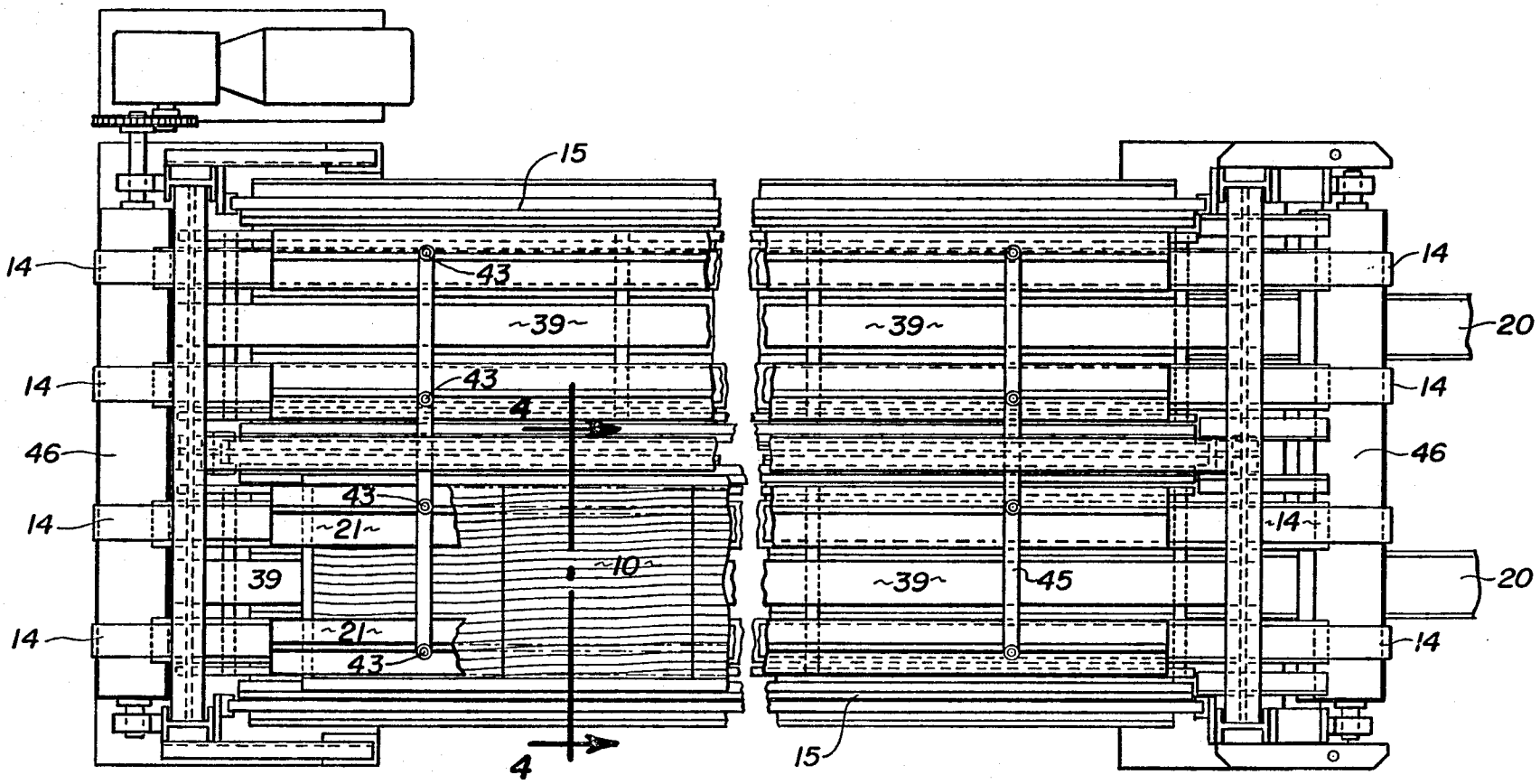
FIG. 3 represents a plan view of said first said apparatus.
Figure 4:
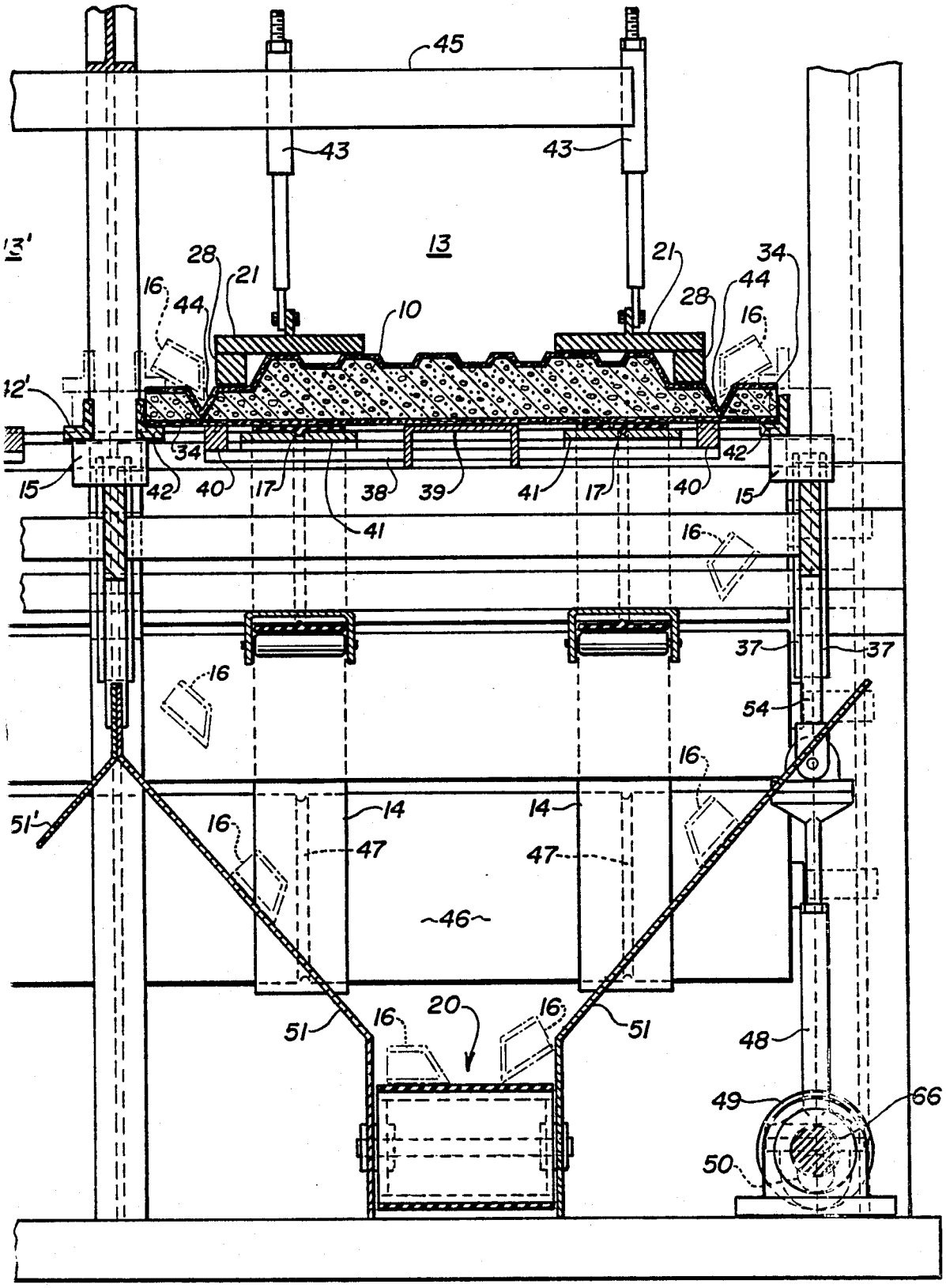
FIG. 4 represents an end view of said first apparatus taken along lines 4—4 of FIG. 3.

The operation of trim-scrap remover 13, and the advantages associated therewith, will be better understood by reference to FIGS. 2–4. As board 10 moves linearly along side-edge trim-scrap remover 13, it is supported by parallel conveyor belts 14, center support 39 and, optionally, edge support 40. Belts 14 are driven by drive roll 46 which possesses alignment notches 47. As the belts move, belt guides 17 which are centered on the belts ride in notches 47, thereby maintaining the alignment of each belt. As belts 14 move along apparatus 13, they move in belt channels 41 which also possess alignment notches. As indicated by the figures, center support 39, belt channels 41, and optional edge support 40 may be further supported by structural bar 38; however, other support arrangements may be provided at the desire of an artisan.

The alignment of board 10 on trim-scrap remover 13 may be maintained by an angular edge guide 42 which comprises a part of edge trim bar 15, as illustrated in the figures. Nevertheless, it will be recognized that if conveyor belts 14 run evenly and the board is properly aligned when it enters apparatus 13, no further alignment may be necessary; thus, the use of guides 42 will not be required.

When board 10 is disposed approximately centrally on trim-scrap remover 13, conveyor belts 14 are stopped, and hold-down plates 21 are lowered so as to contact board 10. In the case of light-weight groove molded boards, it may be necessary to provide additional hold-downs 28 to prevent the boards from flexing, in which case the use of optional underlying edge-supports 40 may be advisable. For ordinary groove-molded boards, however, such added hold-down and support means are normally unnecessary. It is further noted that, regardless of the type of hold-down which is used, it is advisable to provide a soft facing material (not illustrated) for plates 21 and hold-downs 28 so that no damage will occur to the board when the hold-down is interfaced with the board. It will also be recognized that other types of hold-down means, such as vacuum means disposed beneath the boards, may be selected by an ordinary artisan, and that the hold-down means which is selected need not be restricted to that illustrated herein.

The figures illustrate that hold-down plates 21 are attached to rigid supports 43 which, in turn, are attached to support bar 45. Bar 45 is attached to raising and lowering means (not illustrated) which is capable of placing plate 21 in contact with board 10 such that no damage results to the board. It will be recognized, however, that other options are availble to the artisan. Thus, bar 45 might be provided as a nonmovable support, and rigid bar 43 might be replaced by hydraulic raising and lowering means which will similarly suffice to bring plates 21 in contact with board 10. All such variations are within the skill of an ordinary artisan.

Figure 9:
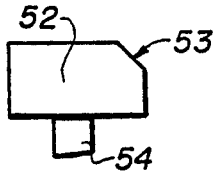
FIG. 9 represents an end view of a beveled block edge-trim bar.

When board 10 has been stopped and hold-down plates 21 have been lowered, edge trim bars 15 are raised so as to effect the separation of side-edge trim scrap 34 from board 10. Removal may be effected by use of an angular edge guide 42 mounted on edge trim bars 15 as shown in the drawings or, alternatively, the separation means may have a different configuration. For example, the separation means may comprise a beveled block 52 having the configuration illustrated in FIG. 9. In that figure, 54 represents a vertically movable support means and 53 represents the beveled face which would come in contact with side-edge trim scrap 34.

With reference to FIGS. 2–4, support bar 54 is capable of moving vertically in way 37. Bar 54 is in turn pivotally attached to bar 48 which is pivotally attached to shaft 66 by eccentric 50. Shaft 66 is attached to air-driven motor 49. By briefly activating motor 49, shaft 66 is caused to rotate one-half revolution, thereby causing bar 48 to rise. The vertical rise in bar 48 is transmitted to edge trim bars 15 by support 54, resulting in the separation of edge scrap 34 from board 10. Separated edge scrap 16 then falls by gravity into scrap chute 51, which guides the separated scrap to scrap conveyor 20. Chute 51 is supported by a series of supports 65. By briefly reactivating motor 49, eccentric 50 is caused to return to its original position, and edge trim bars 15 simultaneously return to their original positions below the bottom plane of board 10.

As illustrated by FIG. 3, it is not necessary to construct side-edge trim-scrap remover 13 so that it is capable of processing only a single line of boards. FIG. 3 illustrates a parallel arrangement whereby two lines of boards are capable of moving through trim-scrap remover 13. Although FIG. 4 is an end view of only one-half of trim-scrap remover 13, the adjacent portion of the trim-scrap remover (13') is visible on the left side of FIG. 4. Thus, 42' and 51' represent the edge guide and chute portions, respectively, of the adjacent trim-scrap remover 13'.

Figure 5:
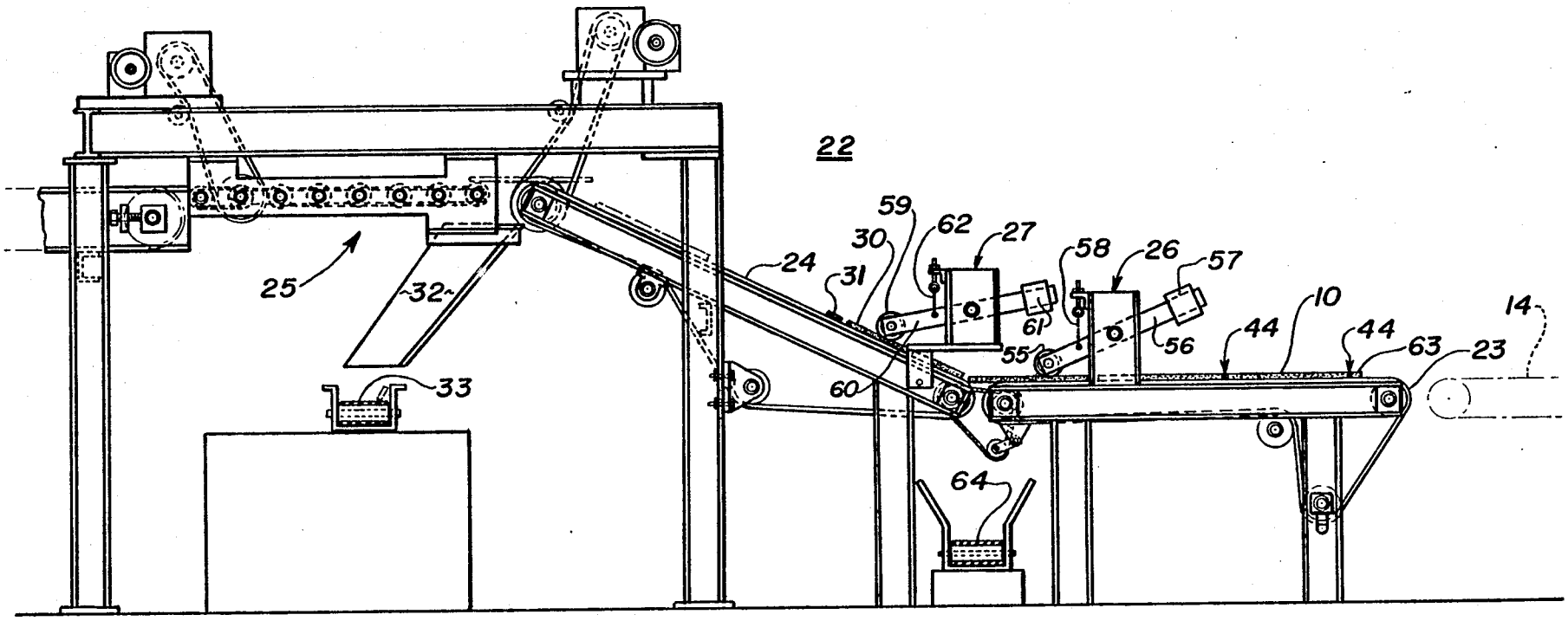
FIG. 5 represents a side view of said second apparatus.
Figure 6:
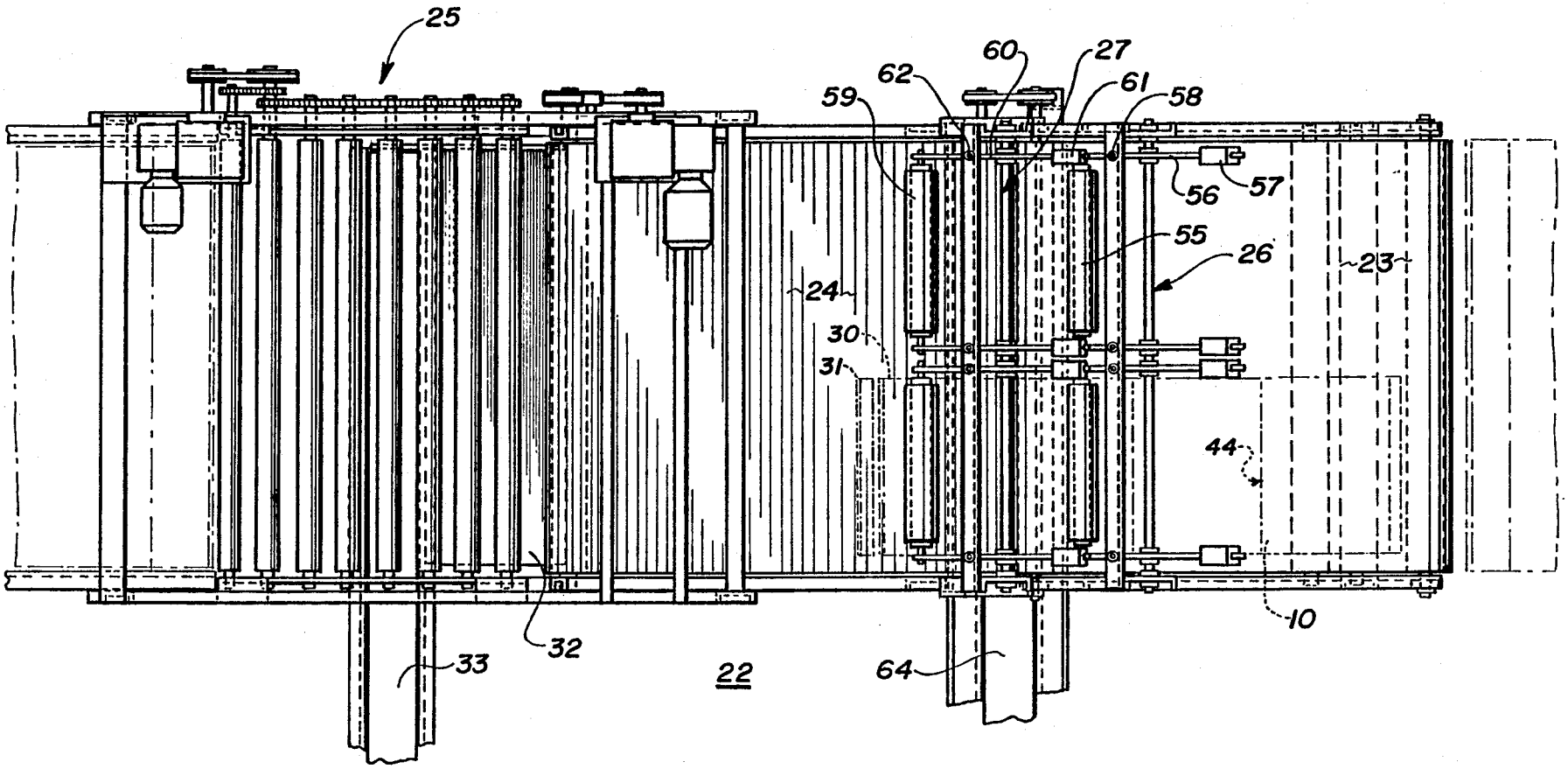
FIG. 6 represents a plan view of said second apparatus.

After removal of the side-edge trim scrap, board 10 comprises a piece of leading-edge scrap 31, the board panels 30 and a piece of trailing-edge scrap 63, all of which are held together as a unitary board in which each segment is defined by upwardly directed transverse groove molding lines 44. This board is then conveyed onto segmenting apparatus 22, which may be more fully visualized by reference to the preferred embodiment shown in FIGS. 5 and 6. Board 10 passes on horizontal conveyor 23 until the leading edge of the board contacts upwardly inclined conveyor 24. In doing so, board 10 passes beneath first roller assembly 26. As illustrated in FIG. 5, roller assembly 26 comprises a roller 55 on a support beam 56, with the weight of roller 55 being counterbalanced by counterweight 57. Roller 55 is disposed near the juncture of conveyor 23 and conveyor 24 and it preferably is disposed such that it either does not contact, or just barely contacts, board 10 when it resides on conveyor 23. This may be achieved by means of height adjusting means 58. The purpose of roller 55 is to hold board 10 substantially in the plane of conveyor 23.

It will also be apparent that the roller assemblies may have other configurations. Thus, instead of employing counterbalanced rollers, rollers may be provided which can move vertically in a slotted groove. Damage to the board could then be avoided by carefully controlling the weight of each roller and/or by providing a spring-loaded mechanism to regulate the vertical movement of the rollers. Further, rollers which are the width of the board may be employed (as illustrated), or segmented rollers may be utilized. All such variations are within the skill of an ordinary artisan.

Figure 8:
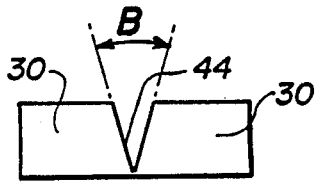
FIG. 8 represents a cross-sectional view of a building board taken along a groove molded line.

As leading edge trim scrap 31 of board 10 contacts inclined conveyor 24, trim scrap 31 is caused to flex upwardly by bending along upwardly directed groove mold line 44. This causes trim scrap 31 to break away from the leading edge of board panel 30 and to be conveyed up conveyor 24. Almost immediately, the leading edge of first board panel 30 contacts inclined conveyor 24 and the panel begins to rise up conveyor 24. The rise of this board panel from the plane of conveyor 23 is resisted by roller 55; however, the pressure of roller 55 is adjusted such that no damage occurs to the panel while it is suspended. The pressure of roller 55 causes the trailing edge of the panel to maintain contact with conveyor 23. Therefore, as panel 30 continues to rise up conveyor 24, the upwardly directed groove molded line between the leading and the following panels bends so as to decrease the arc of angle B (FIG. 8). By the time groove molded line 44 approaches the juncture of conveyors 23 and 24, sufficient stress has been exerted along the bottom of groove molded line 44 to separate the two board segments; thus, the first board panel passes completely onto conveyor 24, the trailing board panel immediately contacts conveyor 24 and the process is repeated. Although it was indicated above that the pressure from roller 55 was adjusted such that no damage occurred to the board, the risk of damage to the board may be further minimized by providing roller 55 with a soft, resilient covering material.

As board panel 30 initially proceeds up inclined conveyor 24, it is also contacted by second roller assembly 27 which, in the normal circumstance, will be identical with roller assembly 26. Thus, roller assembly 27 will be provided, as illustrated, with roller 59, support beam 60, counterweight 61 and height adjusting means 62. Second roller assembly 27 plays little or no part in causing segmentation of board 10 into leading-edge scrap 31 and board panels 30; therefore, segmenting apparatus 22 may be constructed such that it comprises only a single roller assembly 26. It has been found, however, that a single roller assembly 26 disposed over horizontal conveyor 23 will have essentially no ability to segment trailing-edge scrap piece 63 because that scrap piece will no longer be in contact with roller assembly 26 at the time maximum force is required. Accordingly, it will be seen that the primary purpose of roller assembly 27 is to cause stress to occur along the groove molded line which demarcates the last board panel and trailing-edge scrap piece 63, thereby causing trailing-edge piece 63 to segment. This latter segmentation will normally occur before trailing-edge piece 63 reaches the end of conveyor 23. Accordingly, a scrap conveyor 64 may be disposed beneath the juncture of conveyors 23 and 24 so as to receive trailing scrap piece 63. Alternatively, a skid plate may be provided so that trailing scrap piece 63 is also conveyed up conveyor 24.

Figure 10:
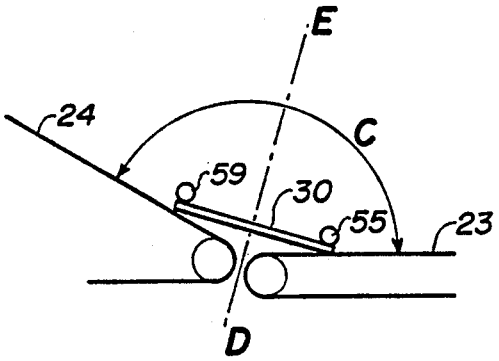
FIG. 10 represents a cross-sectional view of the angle between the first and second conveyors of said second apparatus.

For maximum efficiency in segmenting groove molded building boards, the angle of intersection of conveyors 23 and 24, illustrated by arc C of FIG. 10, should be adjusted such that the difference in degrees between arc C and 180° is greater than the open angle of groove molded line 44 when board 10 resides on a planer surface, provided that the open angle does not exceed about 75°. Thus, as illustrated by FIGS. 8 and 10, if arc B is 28° and the angle of intersection of conveyors 23 and 24 (arc C) is adjusted such that it is 150° (both as illustrated), the difference between 180° and arc C is 30°, a value which is in excess of 28°. This adjustment ensures that as a groove molded line separating two board segments approaches the juncture of conveyors 23 and 24, the angle of arc B will close completely. When the respective faces of groove molded line 44 come together, a fulcrum will be created which will ensure that the still-attached bottom portion of groove molded line 44 will be cleanly ruptured. Such cooperation cannot be attained if the open portion of groove molded line 44 is downwardly directed. Furthermore, it is also not advisable to downwardly direct groove molded line 44 because arc B would be opened wider during segmentation, and this would tend to cause separation of the backing web from the board.

The 75 degree limitation on the groove molded angle (arc B) when calculating the angle of intersection is important for practical reasons. Most groove molded angles will probably be about 26 to 30 degrees because of performance and aesthetic considerations. However, if arc B should be at a value of 90 degrees, the calculation would require that the angle of intersection for the conveyors be less than 90 degrees (e.g., 89 degrees). As previously indicated, the angle of intersection should not be less than 100 degrees; therefore, the preferred method of calculating the angle of incidence should only be used if arc B is 75 degrees or less. For purposes of making the determination, the value of arc B should be determined from the angle at the bottom of the V-groove, and a potentially wider or narrower angle which might be measured from the edge detail of the board (e.g., a tegular edge) should not be utilized.

Although it is preferable to adjust the angle of intersection as indicated above, it may not always be necessary (or possible) to do so. Therefore, arc C may be varied from a minimum angle of about 100° to a maximum angle of about 160°. It will be recognized, of course, that as extreme low angles are approached damage may occur to the boards, and as extreme high angles are approached insufficient stress may be provided such that no segmentation occurs. Accordingly, a value of from about 110° to about 155° is more preferred and an adjustment based on the angle of groove molded line 44 as described above is most preferred.

It is also desirable to dispose rollers 55 and 59 so as to facilitate the separation of the various board segments from one another. The most preferred arrangement is shown in FIG. 10. When the angle of intersection between conveyors 23 and 24 is bisected along line D-E, and a board panel 30 is centered along the line of bisection such that one end is in contact with conveyor 23 and the other is in contact with conveyor 24, rollers 55 and 59 are disposed such that they contact the surface of the panel near its respective ends. Preferably, the contact will be within about 4 inches of the ends, and most preferably about 2 inches from the ends. Such an alignment avoids excess strain on the board while it is suspended and ensures that the board conforms to the path of travel. Nevertheless, board breakage and damage to the board surface is minimized, provided that the pressure of rollers 55 and 59 is properly adjusted. For the foregoing reasons, it is preferable to adjustably mount the roller assemblies on apparatus 22 so as to accommodate a variety of board segment sizes.

As previously indicated, the leading-edge trim-scrap 31 and board panels 30 are conveyed up inclined conveyor 24, at which point board panels 30 are passed individually onto receiving conveyor 25 and eventually to an appropriate inspection and/or packaging station. However, because leading-edge trim scrap 31 has a fairly narrow dimension, it will not be able to pass onto conveyor 25 and it will fall onto chute 32. The scrap is then conveyed away by scrap conveyor 33.

Although a preferred way of practicing the present invention involves a combination of a side-edge trim-scrap removing apparatus 13 and a segmenting apparatus 22, the same result may also be achieved by using two segmenting apparatuses 22 in tandem. Thus, board 10 comprising leading-edge, trailing-edge and side-edge trim scrap pieces may be conveyed onto horizontal conveyor 23, onto inclined conveyor 24, and eventually onto receiving conveyor 25. As the board passes through this sequence of conveyors, the leading-edge scrap and the trailing-edge scrap will be separated, and the board will be segmented, all of which occur in the usual manner. It will be noted, however, that the transverse groove molding lines (FIG. 7) should go completely to the edges of board 10 when two segmenting conveyors are used. This will ensure that complete transverse separation occurs.

If the segmented boards, with side-edge trim pieces still attached, are conveyed from receiving conveyor 25 to a butt plate and then conveyed at right angles to the original line of movement, the side-edge trim pieces will have been turned such that they are at the front and the back of the board segments. If each segment is then conveyed through a second segmenting apparatus, the leading and trailing trim pieces will be separated from the board segments in the usual manner, thereby providing a product which retains no attached scrap edges.

It will, of course, be recognized that modifications of the present invention are well within the skill of an ordinary artisan. Thus, when using a segmenting conveyor of the type illustrated in the figures, the artisan may elect to utilize the segmenting apparatus in a reverse manner by passing boards down conveyor 24 (which becomes the first conveyor) and onto horizontal conveyor 23 (which becomes the second conveyor). The use of such an arrangement is less favored for full-length boards, however, because an artisan cannot pass such a board directly from a horizontal conveyor onto a declining conveyor without causing the board to bend backward; i.e., the board would tend to bend such that groove mold line 44 opened, which would result in a tendency to separate the backing web from the board as indicated above. Such an arrangement may nevertheless be possible if the board is gradually conveyed onto a declining conveyor. This may be accomplished, for example, by using a series of tipples which are well known in the art.

Once the board is on the declining conveyor, separation will occur essentially as described above. The rollers will be employed in the same manner and will ensure that the board segments are held in contact with the declining conveyor as long as possible so as to ensure that minimum stress is placed on the board. Nevertheless, some modifications may be necessary. For example, it is seen in the figures that the boards contact the rollers in a manner which prevents the boards from wedging or jamming as they contact the roller. This problem is avoided by the fact that support means 56 and 60 point in the general direction of travel of the board; i.e., they are trailing rollers. Therefore, it may be advisable to mount the rollers over the declining conveyor and the horizontal conveyor in a trailing manner in order to avoid wedging and jamming.

Although it was noted above that the use of a declining first conveyor would be less favored for full-length boards, there will be other situations where it will be advantageous to use such a conveyor. One example of such a circumstance would be where two segmenting apparatuses 22 are used in tandem as described above. If a board were passed onto a first segmenting apparatus having an inclined conveyor 24 and then onto a second segmenting apparatus having a declining conveyor 24, the first apparatus would segment the board such that only side-edge trim pieces remained. It would then be unnecessary to use tipples to convey the board onto the second segmenting apparatus because these board segments would not be subject to damage by an abrupt change from a horizontal to a declining conveyor. Thus, in such a circumstance, the combined use of inclined and declined conveyors might well be preferred.

Similarly, if wide boards having two or more parallel rows of panels 30, as previously described, are desired to be processed, two segmenting apparatuses may be used to advantage. Of course, the wider the board, the more care will be required in handling because the wide portion of the board will become the long portion of the board as it passes through the second segmenting apparatus. Therefore, the artisan will be required to exercise care to avoid back bending of the board, as described above.

It will also be apparent that it may not be necessary to maintain any of the conveyors of apparatus 22 in a horizontal plane. A more important consideration is the angle at which conveyors 23 and 24 intersect, as indicated above. Therefore, if a suitable angle of intersection is chosen by the artisan, the apparatus may be canted at various angles from the horizontal, the selection being determined by operational and gravitational considerations.

The present invention is not restricted solely to the descriptions and illustrations provided above, but encompasses all modifications envisaged by the following claims.

What is claimed is:

1. An apparatus for removing side-edge trim scrap from a groove molded building board, said apparatus comprising conveyor means, said conveyor means being adapted to receive a groove molded building board comprising upwardly groove molded side-edge trim scrap and to convey said board to a designated position in said apparatus, said conveyor means comprising means for temporarily stopping said board at said position;

hold-down means, said hold-down means being disposed such that it can prevent said board from moving when said board is stopped at said position;

side-edge trim-scrap removing bars disposed beneath said edge scrap when said board is stopped at said position, said bars comprising vertical lifting means whereby said bars may be contacted with said edge scrap so as to cause said scrap to move upwardly, thereby causing said scrap to be separated from said board; and, means for reactivating said conveyor means so as to cause said board to be removed from said apparatus.

2. The invention as set forth in claim 1 hereof wherein said hold-down means comprises hold-down plates.

3. The invention as set forth in claim 1 hereof wherein said side-edge trim-scrap removing bars comprise means for maintaining board alignment.

4. The invention as set forth in claim 1 hereof wherein said apparatus is capable of simultaneously processing a plurality of incoming boards.

* * * * *